US006982675B2

(12) United States Patent
Kwak et al.

(10) Patent No.: US 6,982,675 B2
(45) Date of Patent: Jan. 3, 2006

(54) INTERNAL MULTI-BAND ANTENNA WITH MULTIPLE LAYERS

(75) Inventors: Won Il Kwak, Daejeon (KR); Seong Ook Park, Daejeon (KR); Young Hyuk Ko, Gwangju (KR)

(73) Assignee: Information and Communications University Educational Foundation, Seoul (KR)

( * ) Notice: Subject to any disclaimer, the term of this patent is extended or adjusted under 35 U.S.C. 154(b) by 7 days.

(21) Appl. No.: 10/780,641

(22) Filed: Feb. 19, 2004

(65) Prior Publication Data

US 2005/0128151 A1 Jun. 16, 2005

(30) Foreign Application Priority Data

Dec. 13, 2003 (KR) ..... 10-2003-0090920

(51) Int. Cl.
*H01Q 1/24* (2006.01)

(52) U.S. Cl. ..... 343/702; 300/700 MS; 300/846

(58) Field of Classification Search ..... 343/702, 343/700 MS
See application file for complete search history.

(56) References Cited

U.S. PATENT DOCUMENTS 6,008,764 A * 12/1999 Ollikainen et al. .. 343/700 MS
6,552,686 B2 * 4/2003 Ollikainen et al. .. 343/700 MS

* cited by examiner

*Primary Examiner*—Hoang V. Nguyen
(74) *Attorney, Agent, or Firm*—Oblon, Spivak, McClelland, Maier & Neustadt, P.C.

(57) ABSTRACT

The present invention is directed to an internal multi-band antenna with multiple layers and which comprises a main radiation patch for forming an upper side of the antenna, one side of the main radiation patch connected to a feeder, the main radiation patch including a plurality of strips in the same plane and formed by a folded slit patch of maze type; and at least one auxiliary radiation patch bent downwardly at one side of an edge of the main radiation patch and formed in parallel to the main radiation patch between the main radiation patch and a feeder ground plane.

5 Claims, 11 Drawing Sheets

【Fig.1】
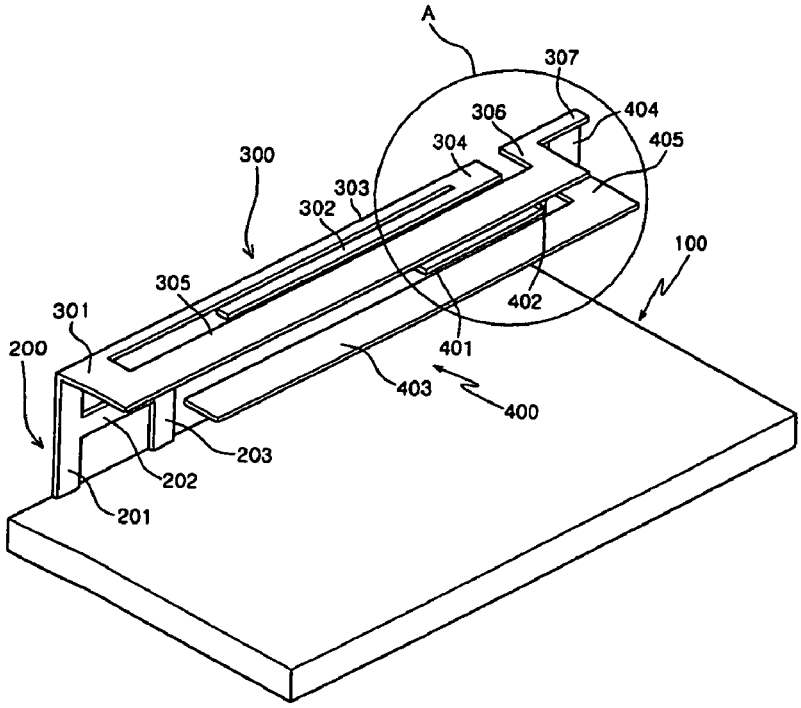
【Fig.2】
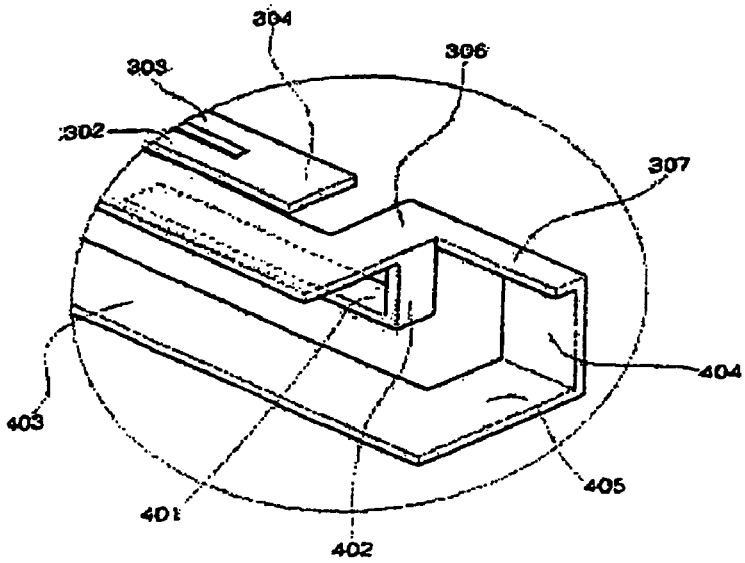

【Fig.3a】
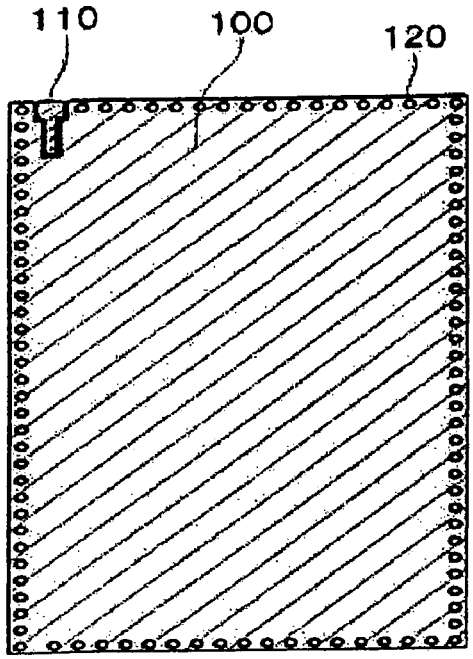
【Fig.3b】
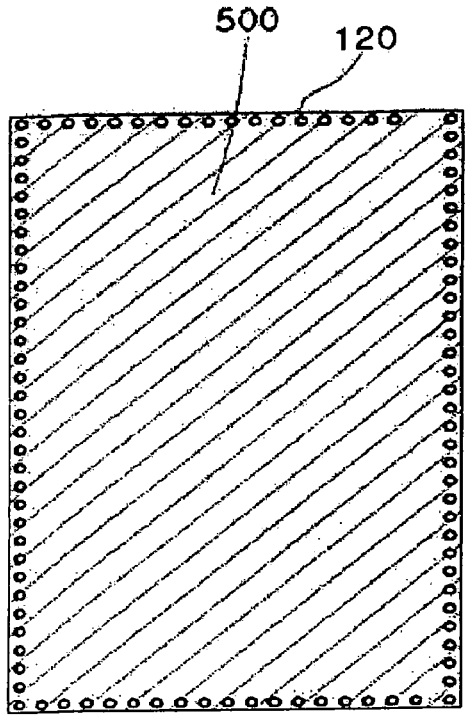

【Fig.4】
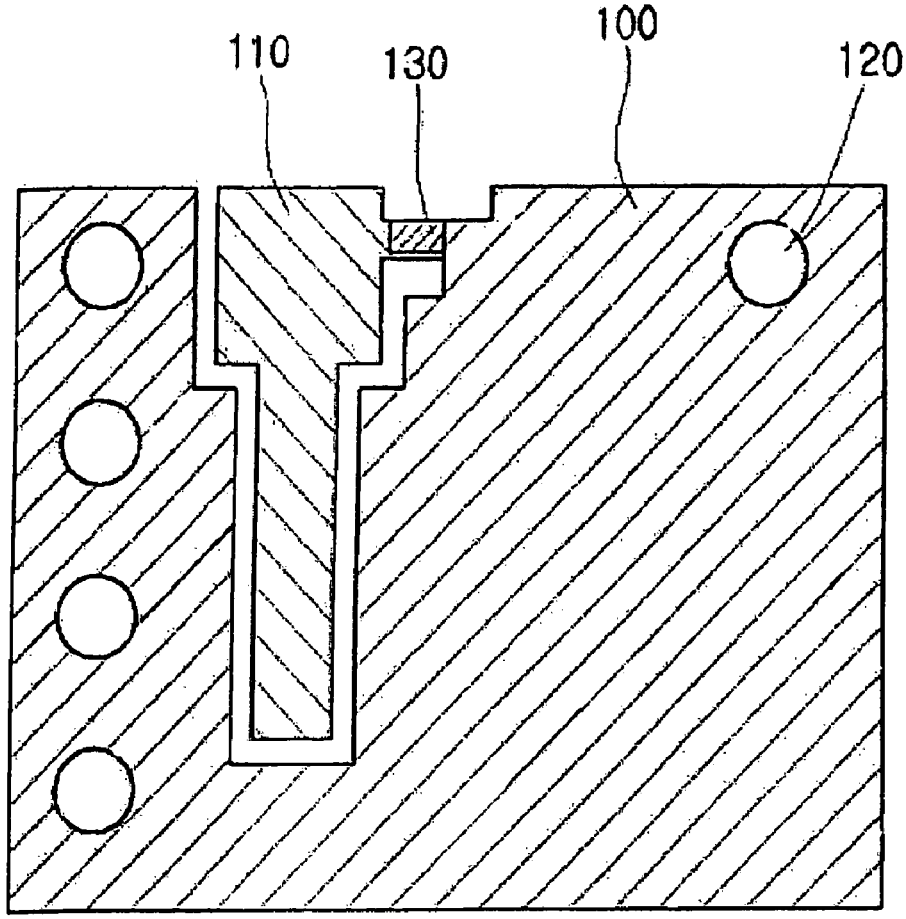

【Fig. 5】
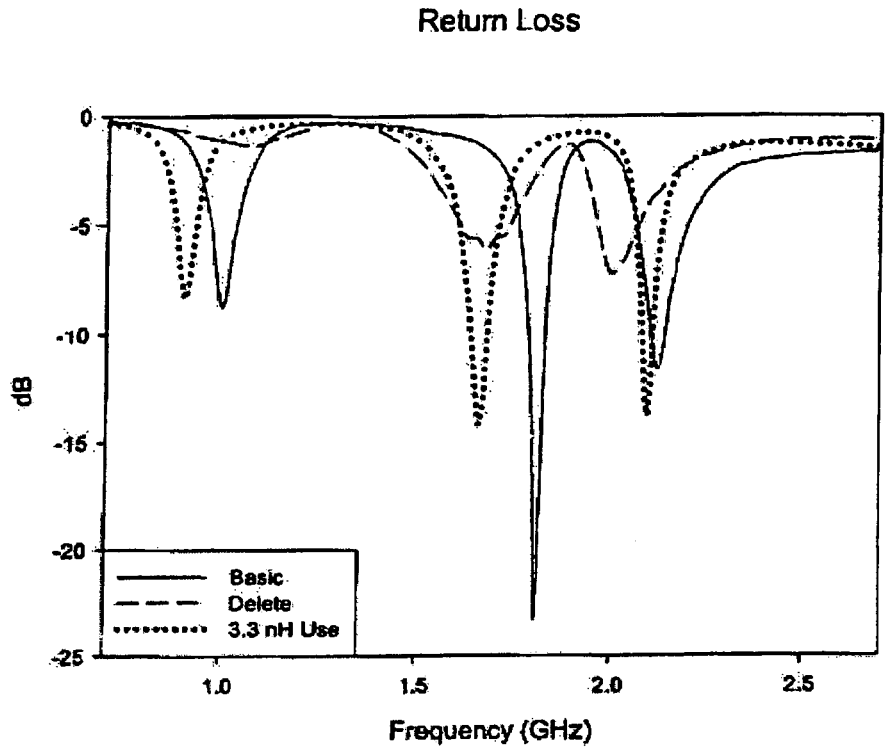
【Fig. 6】
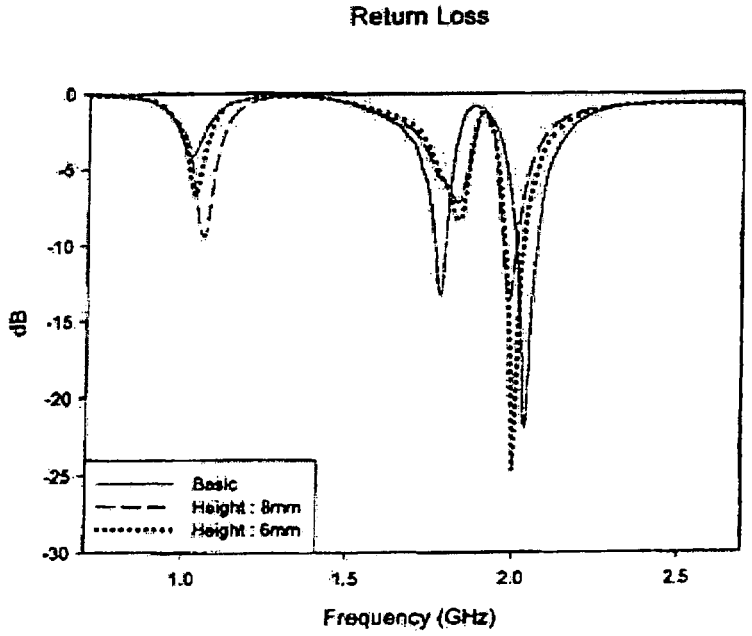

【Fig. 7】
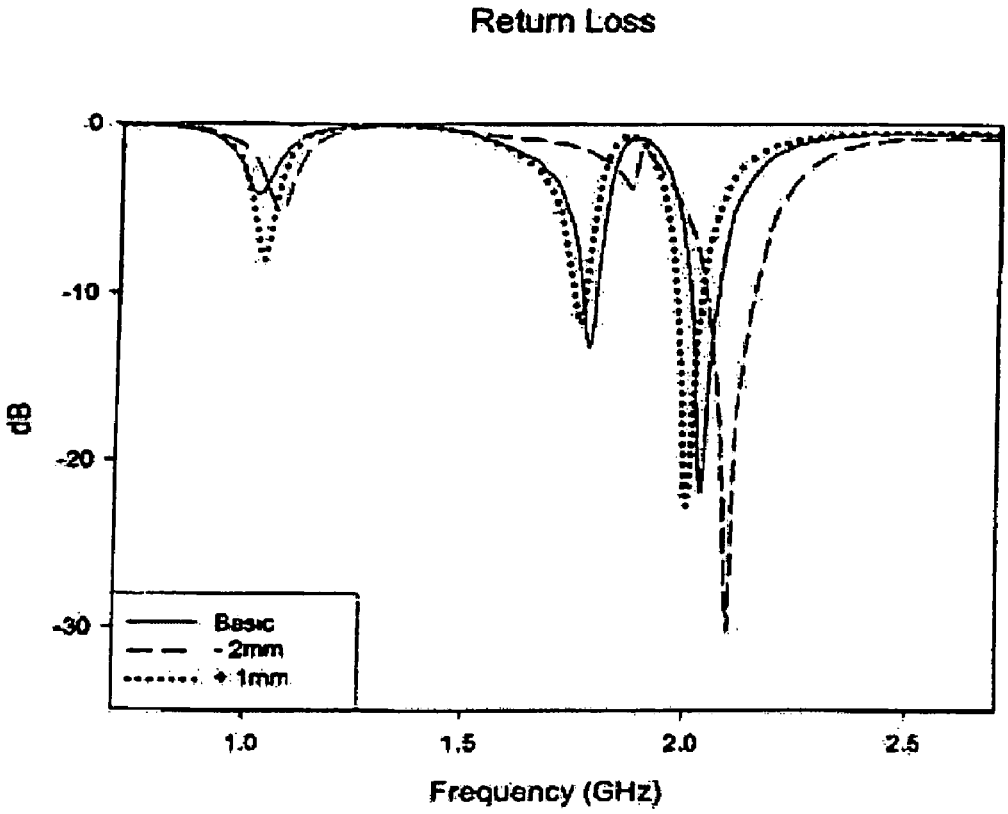

【Fig. 8】
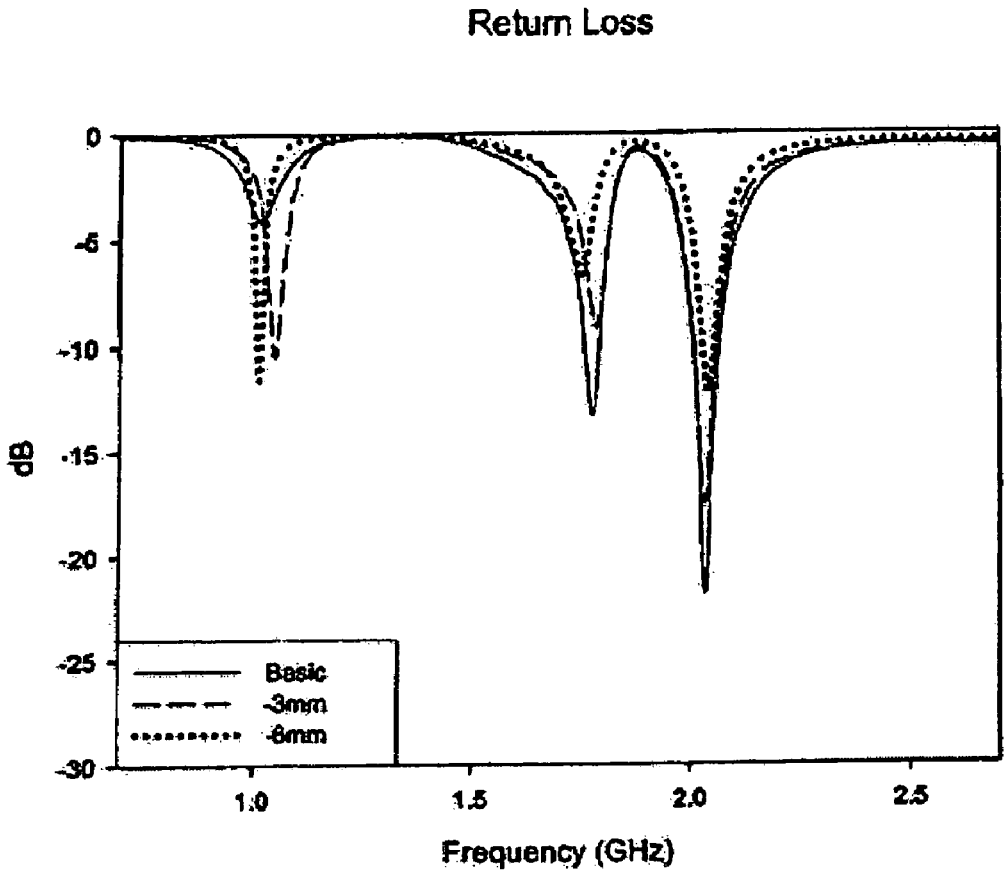

【Fig. 9】
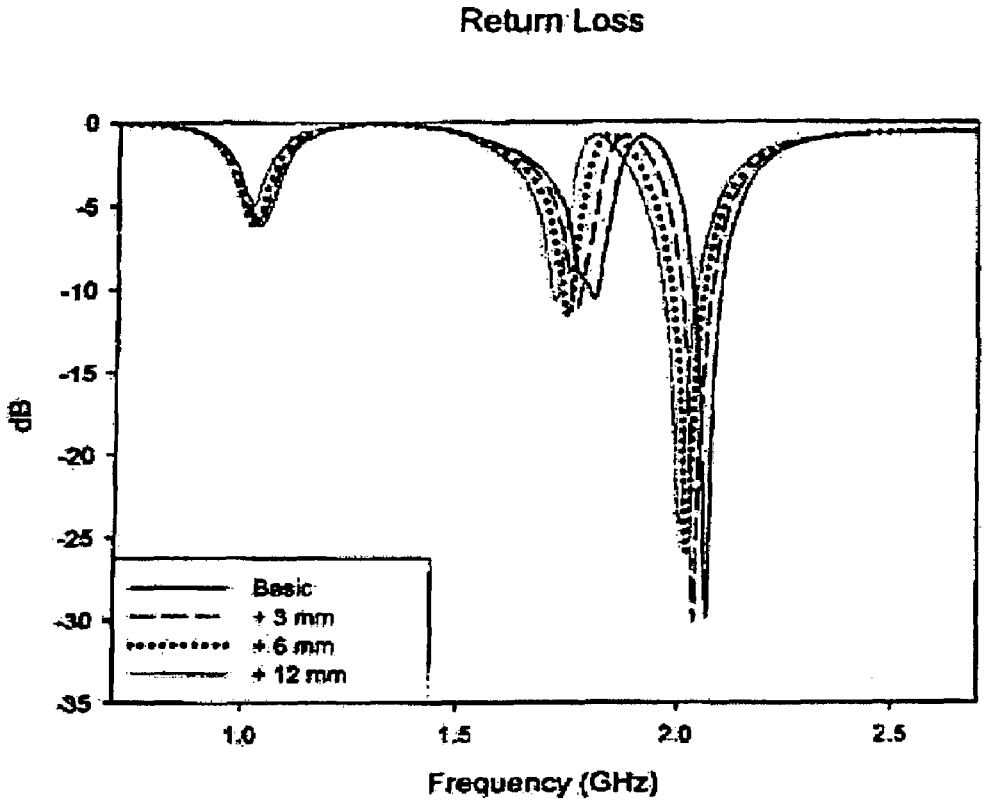

【Fig. 10】
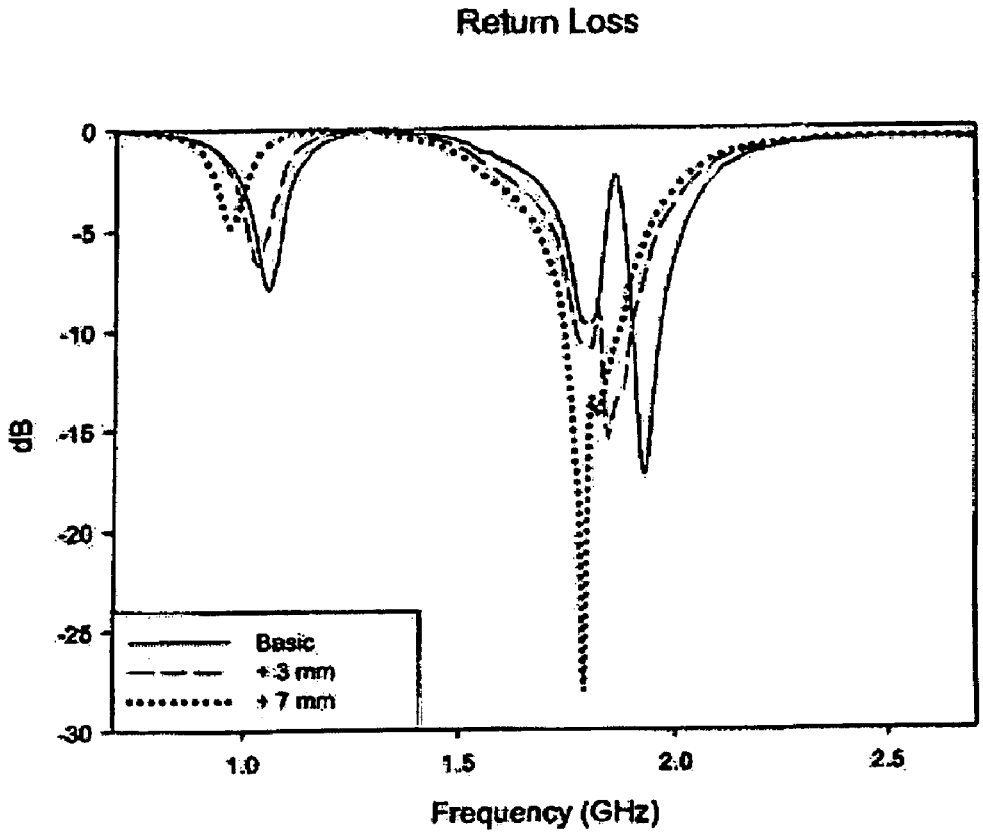

INTERNAL MULTI-BAND ANTENNA WITH MULTIPLE LAYERS

BACKGROUND OF THE INVENTION

1. Field of the Invention

The present invention relates to an internal antenna, and more particularly to an internal antenna with a small-sized structure usable in a multiple band.

2. Description of the Related Art

Typically, helical antennas or linear monopole antennas are used as antennas for potable terminals. However, although these helical antennas or linear monopole antennas have a merit of omni-directional radiation characteristic, since they are of external type projecting outside the terminals, there is a fear of breakage of antennas and their characteristic deterioration due to an external force. Also, they are vulnerable to recently proposed SAR (Specific Absorption Rate).

A portable terminal antenna for a mobile communication are facing with a user's need for good design, convenience of carrying, service commercial use in a multi-band, light-weighting, and low cost. Accordingly, the portable terminal antenna for the mobile communication requires an internal type of the multi-band including an 800 MHz band rather than an external type and are meeting a need for miniaturization using a variety of structures and a variety of materials.

A conventional internal antenna includes a microstrip patch antenna, a planar inverted F antenna, a chip antenna, etc. There have been proposed many methods for effectively miniaturizing these internal antennas. For example, there is a case where a size of the microstrip patch antenna having a relatively high gain and a wideband characteristic is reduced using an aperture coupled feed structure. This provides a miniaturized and light-weighted antenna where a size of the antenna is effectively reduced by inserting a dielectric under an edge portion of a patch with the largest electric field distribution of a $TM_{01}$ mode of the microstrip patch antenna in a longitudinal direction of a resonance patch and a gain reduction of the antenna produced as the dielectric constant is raised is minimized. However, since the miniaturization method used in the conventional antenna is based on a two-dimensional structure, there is a limit to the miniaturization. Furthermore, considering a fact that a space for the antenna in the portable terminal gets reduced due to increase of portable terminal services, there is a keen need of improvement for the miniaturization.

In addition, although a feeding system used in the conventional antenna includes an inverted L type, an inverted F type, etc., there is still a need of improvement in view of a space use or a feeding efficiency.

SUMMARY OF THE INVENTION

In consideration of the above problems of the conventional internal antenna, it is an object of the present invention to provide a new feeding system and antenna structure which is capable of facilitating miniaturization adaptable to a portable terminal for mobile communication and providing a multiplexing service through which multi-channel information composed of different wavelengths in one antenna can be simultaneously transported. In addition, it is another object of the present invention to provide an antenna with a structure where a ground metal conductor is effectively utilized.

In order to achieve the above objects, according to one aspect of the present invention, an internal multi-band antenna comprises a feeder vertically combined to a metal conductor for feeding provided at one side of a ground metal plate, a feeder extension extending vertically from a predetermined position of the feeder; and an inverted Y type feeder structure formed by a feeder ground vertically bent at an end of the feeder extension and grounded to the ground metal plate. Also, in an antenna with multiple layers, an upper plate of a patch antenna connected to the feeder functions as a main radiation patch, which is a folded slit patch of maze type, and a plurality of lower plates bents from one side of an edge of the main radiation patch to the ground metal plate and formed in parallel to the main radiation patch between the main radiation patch and the ground metal plate functions as an auxiliary radiation patch.

BRIEF DESCRIPTION OF THE DRAWINGS

FIG. 1 is a perspective view of a state where antennas of the present invention are combined to a ground metal plate;

FIG. 2 is an enlarged perspective view of A portion of FIG. 1;

FIGS. 3*a* and 3*b* are respectively a top plan view and a bottom plan view showing a structure of PCB to which the antennas are combined;

FIG. 4 is a view showing a parasite element used instead of a feeder extension 202 in an inverted Y type feeder structure;

FIG. 5 is a graph showing an antenna characteristic (return loss) in both of a case of no feeder extension 202 and a case of parasite element 130;

FIG. 6 is a graph showing a variation of a characteristic depending on an antenna height;

FIG. 7 is a graph showing a variation of a characteristic depending on a variation of a length of an upper portion of the feeder extension in an overall feeder length;

FIG. 8 is a graph showing a variation of a characteristic depending on a variation of a length of the feeder extension;

FIG. 9 is a graph showing a variation of a characteristic depending on a variation of a length of an auxiliary radiation patch 401;

FIG. 10 is a graph showing a variation of a characteristic depending on a variation of a length of an auxiliary radiation patch 403;

DESCRIPTION OF THE PREFERRED EMBODIMENTS

Figure 11:
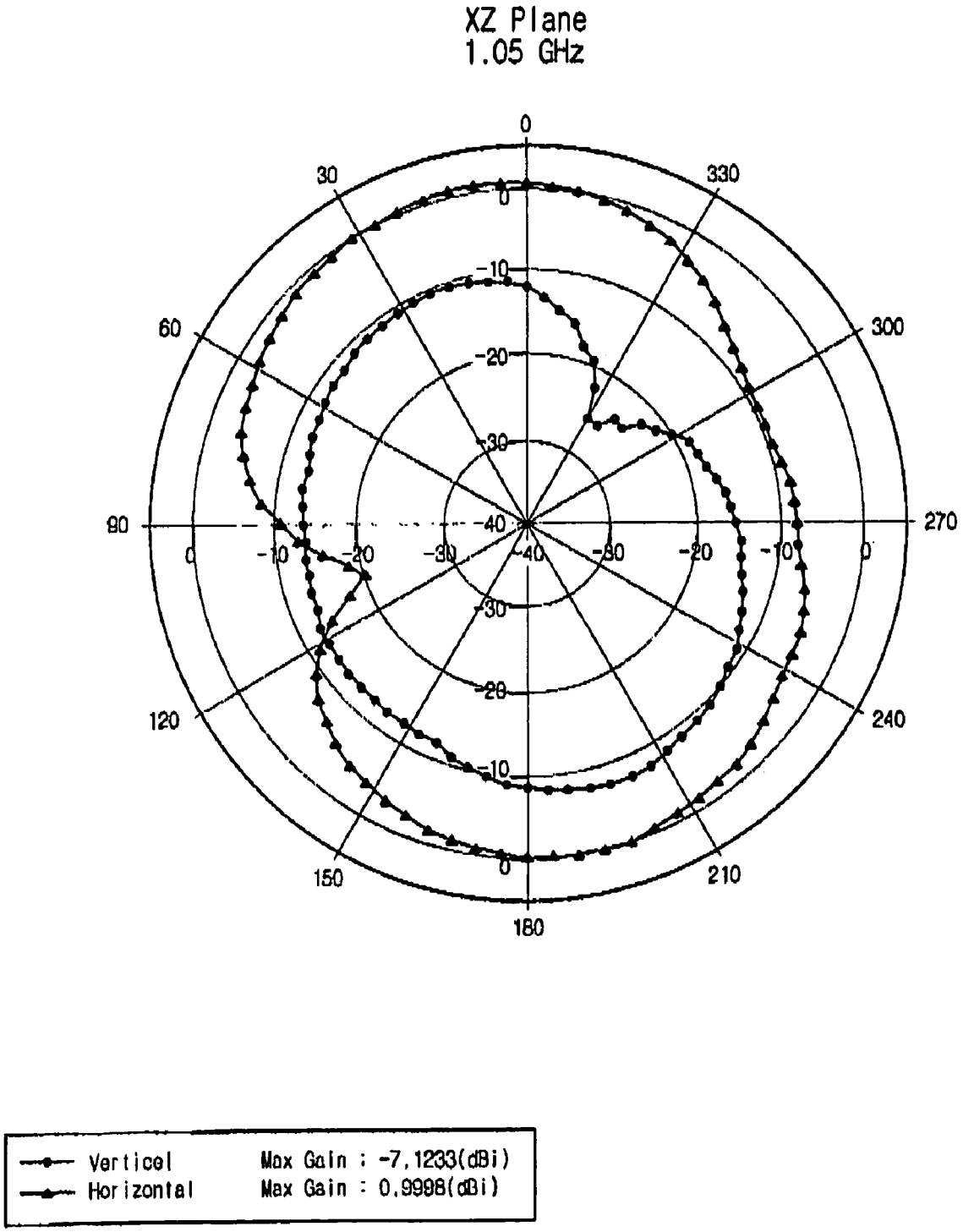
FIG. 11 is a diagram showing a XZ plane radiation pattern in a resonant frequency of 1.05 GHz.

Now, a preferred embodiment of the present invention will be described in detail with reference to the accompanying drawings.

FIG. 1 is a perspective view of a state where antennas of the present invention are combined to a ground metal plate. As shown in FIG. 1, antennas 300 and 400 are combined to a top portion of one of edges of a ground metal plate 100 via a feeder 200. The feeder 200 is vertically combined to the ground metal plate 100.

A main radiation patch 300 forming a top side of the antenna has a folded slit patch structure of maze type and is located in parallel to a plane of the ground metal plate 100.

An auxiliary radiation patch 400 is located in parallel to planes of the main radiation patch 300 and the ground metal plate 100 between the main radiation patch 300 and the ground metal plate 100. The auxiliary radiation patch 400 comprises several strip patches 401 and 403 having different lengths and widths and each of the strip patches 401 and 403 can be located in the same plane or with a multi layer structure.

The feeder 200 comprises a feeder 201, a feeder extension 202, a feeder ground 203, etc. The feeder 201 transmits signals between a portable terminal body and the antennas 300 and 400 and is vertically combined to a metal conductor for feeding provided at one side of the ground metal plate. The feeder extension 202 extends vertically from a predetermined position of the feeder 201 and its length is variable. The feeder ground 203 is bent from an end of the feeder extension 202 to the ground metal plate and is grounded to the ground metal plate. Such a feeder structure is referred to as an inverted Y type, compared to conventional inverted L type, inverted F type, etc.

FIG. 2 is an enlarged perspective view of A portion of FIG. 1.

As shown in FIG. 2, the main radiation patch 300 has a folded slit patch of maze type and comprises several strip patches 301 to 307 having different lengths and widths. A strip patch 301 has an effect on an overall resonance characteristic of the antenna, and, particularly, is an important tuning means for effective design of the resonance characteristic in a CDMA band. A strip patch 302, which is for inducing a resonance over dual band, is formed by granting slits to a general planar patch.

The auxiliary radiation patch 400 is formed in parallel between the main radiation patch 300 and the ground metal plate 100 and each of the strip patches 401 and 403 is bent and extend at an edge of one side of the main radiation patch 300. The strip patch 401 is bent (shown at reference numeral 402) with a predetermined length and width downwardly in the right side (of the figure) of the strip patch 306 and is again bent (shown at reference numeral 401) with a predetermined length and width to the left side (of the figure). The strip patch 403 is bent (shown at reference numeral 404) with a predetermined length and width downwardly in the back side (of the figure) of the strip patch 307, is bent (shown at reference numeral 405) with a predetermined length and width to the front side (of the figure), and then is once more bent with a predetermined length and width to the left side (of the figure). In FIG. 2, although the strip patches 401 and 403 are inwardly bent such that they occupy a minimum space in the plane, they can be configured such that they are bent outwardly in a case where the antennas are located at a center of a PCB.

Here, the strip patch 401 is for improving a miniaturization and characteristic of the whole antenna and the strip patch 503 is for inducing a resonance in a PCS band.

Between the main radiation patch 300 and the auxiliary radiation patch 400 or between the auxiliary radiation patch 400 and the ground metal plate 100, an air layer can be laid or a nonmetallic nonconductor having a predetermined dielectric constant can be inserted. In the case where a dielectric is filled between the main radiation patch 300 and the auxiliary radiation patch 400, via holes penetrating the dielectric between the main radiation patch 300 and the auxiliary radiation patch 400 are formed and inner surfaces of the via holes are coated with conductors, which are then connected to the main radiation patch 300 and the auxiliary radiation patch 400.

FIGS. 3*a* and 3*b* are respectively a top plan view and a bottom plan view showing a structure of PCB to which the antennas are combined. As shown in the figures, the PCB includes the ground metal plate 100 on its upper side, a lower metal plate 500 on its lower side, and via holes 120 for connecting the ground metal plate 100 to the lower metal plate 500, etc. The via holes are formed to penetrate the PCB and their inner surfaces are coated with conductor films for electrically connecting the ground metal plate 100 and the lower metal plate 500.

A metal conductor for feeding 110 is provided at one side of an edge of the ground metal plate in such a manner that the metal conductor for feeding 110 is isolated from the ground metal plate 100. The metal conductor for feeding 110 is in contact with the feeder 201 of the inverted Y feeder structure so that signals are transmitted between the portable terminal body and the antennas. In other words, a current flows by circuit-shorting the metal conductor for feeding 110 on the PCB with the feeder 201 using a connector or a signal line directly supplied from a RF module. The current radiates the maximum electromagnetic field energy in the air at a proper resonant frequency while flowing through the feeder 201.

When the internal antenna is designed, although a metal conductor for ground located in the vicinity of the antenna is common to be removed, the ground metal plate 100 is not removed in the present invention. By leaving the ground metal plate 100 as it is, a space where circuit devices such as a microphone jack and an earphone jack can be designed can be secured between the antennas 300 and 400 and ground metal plate 100 on the top surface of the PCB. In addition, by using the ground metal plate 100 as a reflection plate, the efficiency of the antennas is improved and an electromagnetic wave exerting an adverse effect upon a human body can be significantly intercepted.

FIG. 4 is a view showing a parasite element used instead of the feeder extension 202 in the inverted Y type feeder structure. As shown in FIG. 4, the parasite element 130 is provided near the metal conductor for feeding 110 and is connected to the feeder 201. Here, the parasite element 130, which is an element consisting of R, L, C, etc., can be properly selected considering an input impedance of the feeder and the like.

FIG. 5 is a graph showing an antenna characteristic (return loss) in both of a case of no feeder extension 202 and a case of parasite element 130. If the feeder extension 202 is removed, a structure of the antenna feeder is changed from the inverted Y type structure to a feed structure of a simple microstrip patch antenna. Observing a variation of an antenna characteristic after the removal of the feeder extension 202, an overall resonance of the antenna is significantly reduced and a resonance band is widened, compared to a state where the feeder extension 202 is not removed (a basic state). In addition, a CDMA resonant frequency moves to a high frequency and a resonant frequency in GPS and PCS bands moves a low frequency.

Observing an antenna characteristic in the case where the parasite element 130 is used, the resonant frequency in CDMA and GPS bands moves a low frequency, compared to the state where the feeder extension 202 is not removed (the basic state). By the way, although a characteristic of a return loss is mostly reduced when the resonant frequency moves to the low frequency, there is here little variation of a resonance characteristic. This result shows that the parasite element 130 can be used instead of the feeder extension 202 in the CDMA and GPS bands when the antenna is designed. This contributes to a design for miniaturization of the antenna. On the other hand, although the resonant frequency moves to the low frequency in the PCS band, since the width of movement of the resonant frequency is minute and a resonance characteristic according to the movement becomes deteriorated, there is little advantage in using the parasite element 130 instead of the feeder extension 202 in the PCS band when the antenna is designed.

Hereinafter, an antenna characteristic depending on a length of the feeder and a length of a strip forming the antenna will be described. Here, Agilent E8357A (300 KHz–6 GHz) PNA Series Network Analyzer is used as a measurement equipment. Also, a copper plate of 0.2 mm in thickness and more than 2 mm in width is used as the strip.

FIG. 6 is a graph showing a variation of a characteristic depending on an antenna height. As shown in FIG. 6, from an observation of the variation of the characteristic depending on the antenna height, it can be seen that the CDMA band has a good resonant characteristic and is wide when the antenna height is 8 mm. However, as the antenna height increases, the resonant characteristic in the GPS and PCS bands becomes deteriorated and the width of the PCS band becomes also reduced.

FIG. 7 is a graph showing a variation of a characteristic depending on a variation of a length of a feeder in an upper portion of the feeder extension in an overall feeder length. As shown in FIG. 7, in a state where the overall length of the feeder 201 is fixed at 7 mm, as the length of the feeder in the upper portion of the feeder extension increases, a resonant frequency moves to a low frequency. Accordingly, it is beneficial to miniaturization of the antenna to increase the length of the feeder in the upper portion of the feeder extension in the overall feeder length.

FIG. 8 is a graph showing a variation of a characteristic depending on a variation of a length of the feeder extension. As shown in FIG. 8, in a state where a feeder height is fixed at 7 mm, as the length of the feeder extension decreases, a bandwidth becomes narrow.

FIG. 9 is a graph showing a variation of a characteristic depending on a variation of a length of the auxiliary radiation patch 401. As shown in FIG. 9, as the length of the auxiliary radiation patch 401 increases, a resonant frequency in all bands moves to a low frequency. Accordingly, an overall size of the antenna can be further reduced.

FIG. 10 is a graph showing a variation of a characteristic depending on a variation of a length of the auxiliary radiation patch 403. As shown in FIG. 10, as the length of the auxiliary radiation patch 401 increases, a resonant frequency in the CDMA and PCS bands moves to a low frequency although there is little movement of a resonant frequency in the GPS band.

In the above, although the characteristic variation of the antenna is described in connection with the length of the feeder and the strip, a variation of a width of the strip is also an important factor. Particularly, a characteristic in a low frequency band depends on the width rather than the length.

Figure 12:
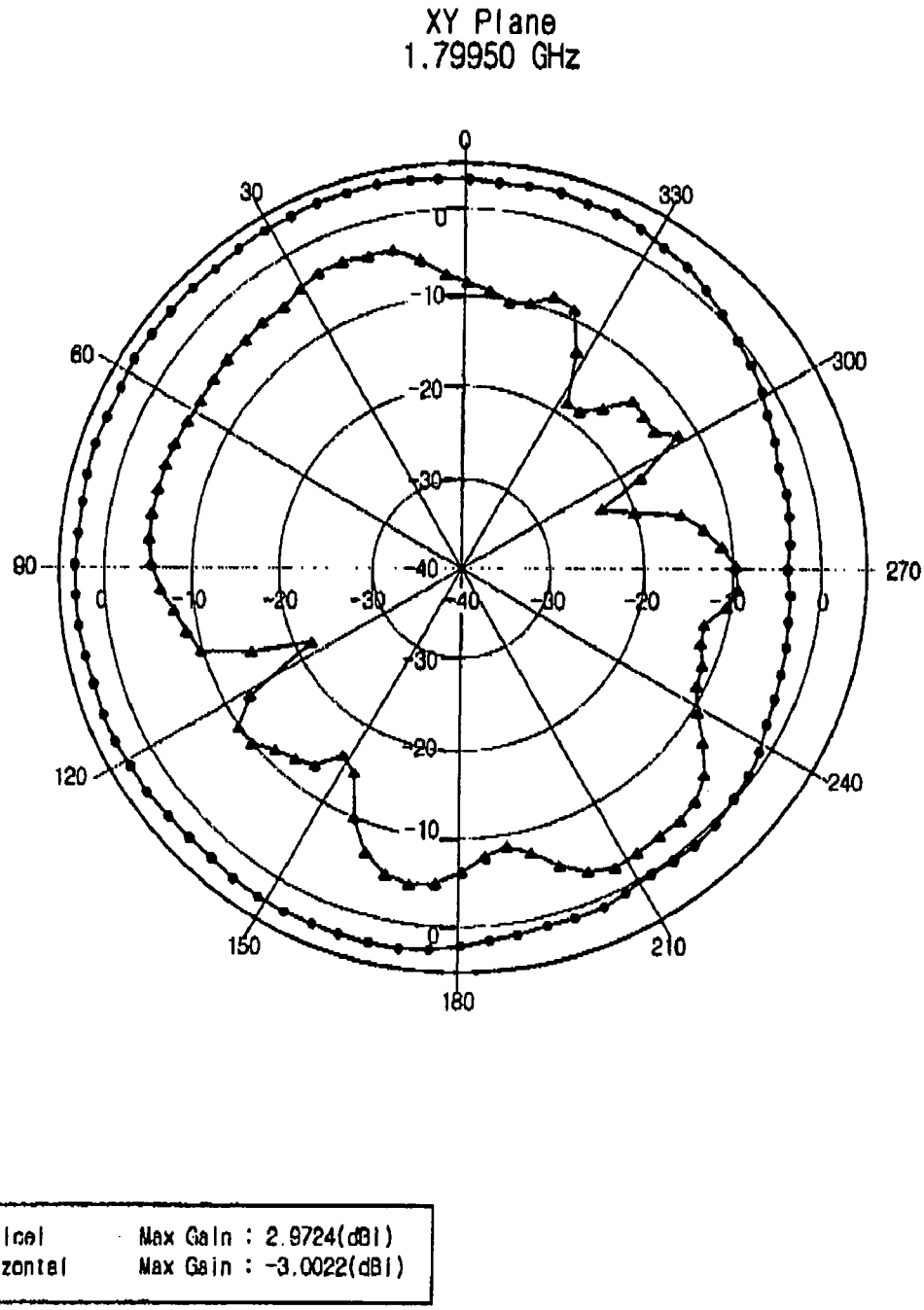
FIG. 12 is a diagram showing a XY plane radiation pattern in a resonant frequency of 1.79950 GHz.
Figure 13:
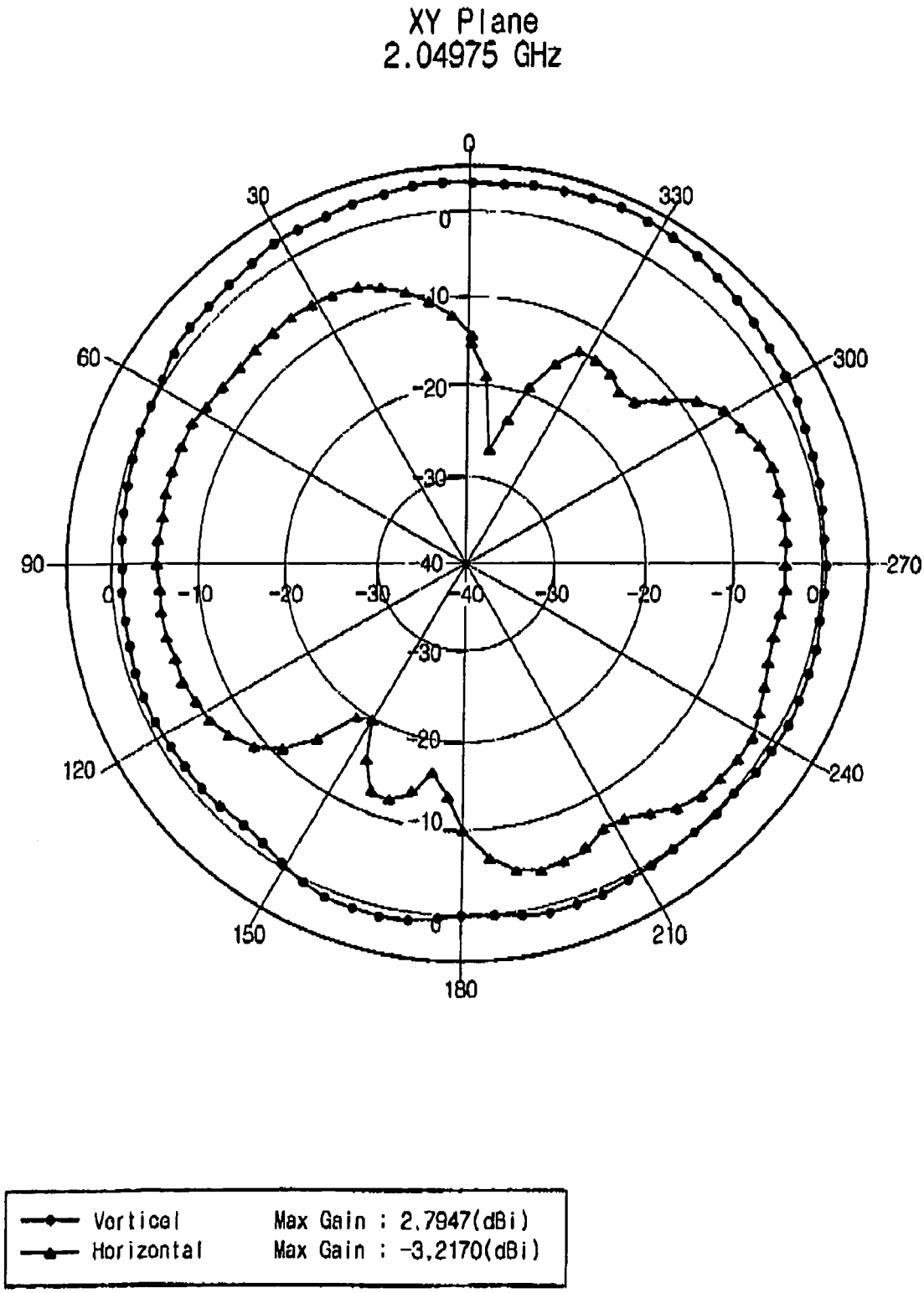
FIG. 13 is a diagram showing a XY plane radiation pattern in a resonant frequency of 2.04975 GHz.

FIG. 11 is a diagram showing a XZ plane radiation pattern in a resonant frequency of 1.05 GHz, FIG. 12 is a diagram showing a XY plane radiation pattern in a resonant frequency of 1.79950 GHz, and FIG. 13 is a diagram showing a XY plane radiation pattern in a resonant frequency of 2.04975 GHz. From a measurement result of a radiation pattern of an antenna designed and manufactured in the present invention using a FFS in a RAC, it can be seen that a good radiation gain of more than 0 dBi can be obtained in all bands, such as XZ Plane 0.9998 dBi in the CDMA band of 1.05 GHz, XY Plane 2.9724 dBi in the GPS band of 1.799 GHz, and XY Plane 2.7947 dBi in the PCS band of 2.04975 GHz.

The antenna according to the present invention is an antenna designed to be usable in a band of GSM, DCS, Bluetooth and the like as well as CDMA (824 MHz–894 MHz), GPS (1.57542 GHz), and UPCS (1859 MHz–1990 MHz) through a proper tuning process. An antenna is a passive device on which the environment has a great effect. Therefore, a characteristic of the antenna can be greatly varied depending on a space at which the antenna is located. The antenna according to the present invention generates a resonance characteristic in frequencies of 1.05 GHz, 1.79 GHz and 1.98 GHz in the air other than a commercial frequency band, but, generally, these resonant frequencies can move to the commercial frequency band when any portable mock up is applied.

Although the internal antenna according to the present invention does not show a satisfactory result in a characteristic of a return loss, it has little difference from an external antenna in terms of a characteristic of a radiation gain, which is an important factor in an actual environment where the antenna is used. Particularly, by modifying an antenna structure to a multi layer structure, the antenna can be further miniaturized.

In addition, the internal antenna according to the present invention has multiple resonant bands and various tuning points, so that a selective use in a required use frequency band is possible, a characteristic in each resonant band is good and a radiation pattern is omni-directional.

What is claimed is:

1. An internal multi-band antenna with multiple layers for use in a portable terminal, comprising:

a main radiation patch for forming an upper side of the antenna, one side of the main radiation patch connected to a feeder, the main radiation patch including a plurality of strips in the same plane and formed by a folded slit patch of maze type;

at least one auxiliary radiation patch bent downwardly at one side of an edge of the main radiation patch and formed in parallel to the main radiation patch between the main radiation patch and a feeder ground plane;

a feeder connected to one side of the main radiation patch for transmitting receive signals of the antenna and radiation signals of a body of the portable terminal;

a feeder extension extending vertically from a predetermined position in a longitudinal direction of the feeder;

an inverted Y type feeder structure formed by a feeder ground bent at an end of the feeder extension and contacting a ground plane;

a ground metal plate in contact with the feeder ground;

a metal conductor for feeding formed in such a manner that the metal conductor for feeding is isolated from the ground metal plate, one side of the metal conductor for feeding connected to the feeder and the other side of the metal conductor for feeding connected to a signal line of the body of the portable terminal;

an insulating plate provided at a lower side of the ground metal plate and having a plurality of via holes penetrating the insulating plate in a width direction, inner surfaces of the via holes coated with conductors; and a PCB provided at a lower side of the insulation plate and including a lower metal plate electrically connected to the ground metal plate through the via holes of the insulation plate and the inner coated conductors.

2. The internal multi-band antenna according to claim 1, wherein the auxiliary radiation patch is bent inwardly.

3. An internal multi-band antenna with multiple layers for use in a portable terminal, comprising:

a feeder for transmitting receive signals of the antenna and radiation signals of a body of the portable terminal;

a feeder extension extending vertically from a predetermined position in a longitudinal direction of the feeder;

an inverted Y type feeder structure formed by a feeder ground bent at an end of the feeder extension and contacting a ground plane;

a main radiation patch for forming an upper side of the antenna, one side of the main radiation patch connected to the feeder, the main radiation patch including a plurality of strips in the same plane and formed by a folded slit patch of maze type;

at least one striped auxiliary radiation patch provided in parallel to the main radiation patch between the main radiation patch and a feeder ground plane;

a dielectric layer inserted between the main radiation patch and the auxiliary radiation patch and having via holes penetrating downwardly from one side of an edge of the main radiation patch and connected to one side of an edge of the auxiliary radiation patch, inner surfaces of the via holes being coated with conductive material for connecting the main radiation patch with the auxiliary radiation patch;

a ground metal plate in contact with the feeder ground;

a metal conductor for feeding formed in such a manner that the metal conductor for feeding is isolated from the ground metal plate, one side of the metal conductor for feeding connected to the feeder and the other side of the metal conductor for feeding connected to a signal line of the body of the portable terminal;

an insulating plate provided at a lower side of the ground metal plate and having a plurality of via holes penetrating the insulating plate in a width direction, inner surfaces of the via holes coated with conductors; and a PCB provided at a lower side of the insulation plate and including a lower metal plate electrically connected to the ground metal plate through the via holes of the insulation plate and the inner coated conductors.

4. The internal multi-band antenna according to claim 3, wherein the auxiliary radiation patch is bent inwardly.

5. An internal multi-band antenna with multiple layers for use in a portable terminal, comprising:

a feeder connected to one side of the antenna;

a ground metal plate in contact with a portion of an end of the feeder;

a metal conductor for feeding formed in such a manner that the metal conductor for feeding is isolated from the ground metal plate, one side of the metal conductor for feeding connected to the feeder and the other side of the metal conductor for feeding connected to a signal line of a body of the portable terminal;

a parasite element provided in the vicinity of the metal conductor for feeding and connected to the feeder for adjusting an input impedance of the feeder in order to minimize a return loss;

an insulating plate provided at a lower side of the ground metal plate and having a plurality of via holes penetrating the insulating plate in a width direction, inner surfaces of the via holes coated with conductors; and a lower metal plate provided at a lower side of the insulation plate and electrically connected to the ground metal plate through the via holes of the insulation plate and the inner coated conductors.

* * * * *